US006651274B2

(12) United States Patent
Swihart et al.

(10) Patent No.: US 6,651,274 B2
(45) Date of Patent: Nov. 25, 2003

(54) MULTI-PURPOSE SEAT/BED HAVING AUTOMATIC LOCK/UNLOCK CAPABILITY

(75) Inventors: Robert K. Swihart, Goshen, IN (US); Keith L. Swihart, Goshen, IN (US)

(73) Assignee: Flair Interiors, Inc., Goshen, IN (US)

( * ) Notice: Subject to any disclaimer, the term of this patent is extended or adjusted under 35 U.S.C. 154(b) by 0 days.

(21) Appl. No.: 09/968,671

(22) Filed: Oct. 1, 2001

(65) Prior Publication Data

US 2003/0061655 A1 Apr. 3, 2003

(51) Int. Cl.[7] ..... A47C 17/175
(52) U.S. Cl. ..... 5/47; 5/37.1
(58) Field of Search ..... 5/37.1, 41, 47

(56) References Cited

U.S. PATENT DOCUMENTS

| | | | | | |
|---|---|---|---|---|---|
| 789,903 | A | * | 5/1905 | Fenner | 5/47 |
| 820,826 | A | * | 5/1906 | Seng | 5/47 |
| 1,734,214 | A | | 11/1929 | Jones | 296/65.13 |
| 1,962,528 | A | | 6/1934 | Rope | 296/64 |
| 2,059,978 | A | * | 11/1936 | Wunderlich | 5/47 |
| 2,107,993 | A | * | 2/1938 | Fox | 5/47 |
| 2,209,880 | A | * | 7/1940 | Fox | 5/47 |
| 2,224,825 | A | * | 12/1940 | Karakauer et al. | 5/47 |
| 2,236,351 | A | * | 3/1941 | Krakauer | 5/47 |
| 2,295,083 | A | * | 9/1942 | Jonassen | 5/47 X |
| 2,321,708 | A | * | 6/1943 | Sklar | 5/47 X |
| 2,330,059 | A | * | 9/1943 | Krakauer et al. | 5/47 |
| 2,334,493 | A | * | 11/1943 | Johnson | 5/47 |
| 2,341,616 | A | * | 2/1944 | Hoffman | 5/47 |
| 2,395,424 | A | * | 2/1946 | O'Neil | 5/47 |
| 2,429,260 | A | | 10/1947 | Coopersmith | 5/47 |
| 2,437,580 | A | * | 3/1948 | Wilson | 5/47 |
| 2,437,949 | A | * | 3/1948 | Fox et al. | 5/47 |
| 2,447,683 | A | * | 8/1948 | Boiu | 5/47 |
| 2,493,096 | A | * | 1/1950 | Wilson | 5/47 |
| 2,495,413 | A | * | 1/1950 | Harman | 5/47 |
| 2,501,464 | A | * | 3/1950 | Bernstein | 5/47 |
| 2,567,263 | A | * | 9/1951 | Wilson | 5/47 |
| 2,601,683 | A | * | 7/1952 | Bebry et al. | 5/37.1 X |
| 2,625,693 | A | * | 1/1953 | Raginsky | 5/47 X |
| 2,629,883 | A | * | 3/1953 | Nowell | 5/47 X |
| 2,651,054 | A | * | 9/1953 | Krakauer | 5/47 |
| 2,672,625 | A | * | 3/1954 | Rhodes et al. | 5/47 |
| 2,694,814 | A | * | 11/1954 | Doner | 5/47 |

(List continued on next page.)

FOREIGN PATENT DOCUMENTS

| | | | | |
|---|---|---|---|---|
| BE | 510907 | * | 5/1952 | 5/47 |
| FR | 1025925 | * | 4/1953 | 5/47 |
| GB | 680974 | * | 10/1952 | 5/47 |

*Primary Examiner*—Robert G. Santos
(74) *Attorney, Agent, or Firm*—Woodard, Emhardt, Moriarty, McNett & Henry LLP

(57) ABSTRACT

A hinge assembly is mounted on a rail supported above a floor by two legs to support one end of a sofa/bed. A like hinge assembly is mounted the same way at the other end of the sofa/bed. The hinge assemblies include side rails supporting front and rear sofa frame members. Each hinge assembly combines front and rear pivot arms supporting a seat bracket, a backrest bracket and an intermediate hinge plate. A latch arm is pivoted to the seat bracket and received through a loop fastened on the intermediate hinge plate and on which a stop is provided. The latch arm is spring biased against the stop and includes a notch receivable in the stop to latch the arm. A latch dog is provided in the arm and which can be toggled between a position enabling latching of the arm against the stop, and a position enabling release of the arm from the stop. The organization of the components enables conversion of the sofa from a forward facing backrest configuration to a bed configuration to a rearward facing backresting configuration by merely handling the front edge of the seat in various movements upward and downward and without separate pull handles, knobs, cables, and without simultaneously or separately handling the backrest along with the seat.

10 Claims, 10 Drawing Sheets

U.S. PATENT DOCUMENTS

| | | | | | |
|---|---|---|---|---|---|
| 2,719,985 | A | * | 10/1955 | Lichter et al. | 5/47 |
| 2,755,487 | A | * | 7/1956 | Harman | 5/47 X |
| 3,059,964 | A | | 10/1962 | Hoppe et al. | 297/13 |
| 3,165,350 | A | | 1/1965 | Willson | 296/156 |
| 3,751,740 | A | | 8/1973 | Belk | 5/37.1 |
| 3,844,608 | A | | 10/1974 | Freedman | 297/92 |
| 3,856,347 | A | * | 12/1974 | Bell et al. | 297/92 |
| 3,955,846 | A | | 5/1976 | Murphy | 296/65.09 |
| 4,085,962 | A | | 4/1978 | Wahls | 296/65.13 |
| 4,266,822 | A | | 5/1981 | Barecki et al. | 296/64 |
| 4,654,902 | A | | 4/1987 | Shrock et al. | 5/37.1 |
| 4,771,507 | A | | 9/1988 | Draplin et al. | 16/297 |
| 4,779,917 | A | | 10/1988 | Campbell et al. | 296/65.09 |
| 4,793,649 | A | | 12/1988 | Yamano et al. | 296/65.09 |
| 4,955,973 | A | | 9/1990 | Provencher | 296/65.07 |
| 5,039,155 | A | | 8/1991 | Suman et al. | 296/65.03 |
| 5,056,849 | A | | 10/1991 | Norris, Jr. et al. | 296/65.05 |
| 5,197,776 | A | | 3/1993 | Brown | 296/65.03 |
| 5,238,285 | A | | 8/1993 | Holdampf et al. | 296/65.03 |
| 5,498,052 | A | | 3/1996 | Severini et al. | 296/65.09 |
| 5,787,522 | A | | 8/1998 | Swihart | 5/45 |
| 6,082,805 | A | | 7/2000 | Gray et al. | 296/65.09 |
| 2003/0061655 | A1 | * | 4/2003 | Swihart et al. | 5/37.1 |

* cited by examiner

MULTI-PURPOSE SEAT/BED HAVING AUTOMATIC LOCK/UNLOCK CAPABILITY

BACKGROUND OF THE INVENTION

1. Field of the Invention

This invention relates generally to sofa-bed assemblies, and more particularly to such assemblies having particular versatility for use where available space is limited, such as in vehicles, for example.

2. Description of the Prior Art

Sofa-beds of various construction have been used for many years in mobile homes, recreational vehicles and other environments. Early examples enabled conversion of a unit between a seat configuration such as a sofa, and a flat configuration such as a bed. Typically, when in a seat configuration, they faced in one direction. Some have provided for easy access to storage space below the unit. An example is U.S. Pat. No. 5,787,522 issued to me on Oct. 4, 1998.

More recently, an assembly has been developed which enables the conversion of a unit between a configuration of a seat facing in one direction, to a bed, to a seat facing in the opposite direction, with ability to access storage space beneath the assembly. Such arrangement is disclosed in U.S. Pat. No. 6,082,805 issued to me and Larry E. Gray on Jul. 4, 2000. While that assembly is very effective for its intended purpose, operation of it involves use of manually operated knobs or tabs, and associated cabling, to change configurations. It is an object of my present invention to provide similar versatility but without the use of cabling and associated manipulators.

SUMMARY OF THE INVENTION

One aspect of the present invention is a method of converting a seating device from a seat with a forward facing backrest, to a bed and back to a seat by simply manually raising and moving the seat, without manual attention to any other features of the seating assembly and without knobs and cabling or the like. Another aspect of the invention is reconfiguring the seat assembly from a bed configuration to a rearward-facing backrest, and doing so without handling any portion of the assembly except for the seat, and without any cables or knobs or the like. A still further aspect of the invention is to enable access to storage space under the seat by simply raising the front edge of the seat and permitting it to latch in a storage access position, following which return to original position is again accomplished by simply manipulating the seat itself.

A further aspect of the invention is a hinge assembly incorporating a seat carrier, a backrest carrier, a hinge carrier intermediate the seat and backrest carriers with pivotal connections to each, in combination with a latching arm on one of the carriers and a stop on the other carrier, and a linkage, the combination enabling the latching arm and stop to cooperate for enabling the locking of components in certain relationships and intentionally releasing the locking feature, all by moving the seat brackets in various ways.

DESCRIPTION OF THE PREFERRED EMBODIMENT

Figure 1:
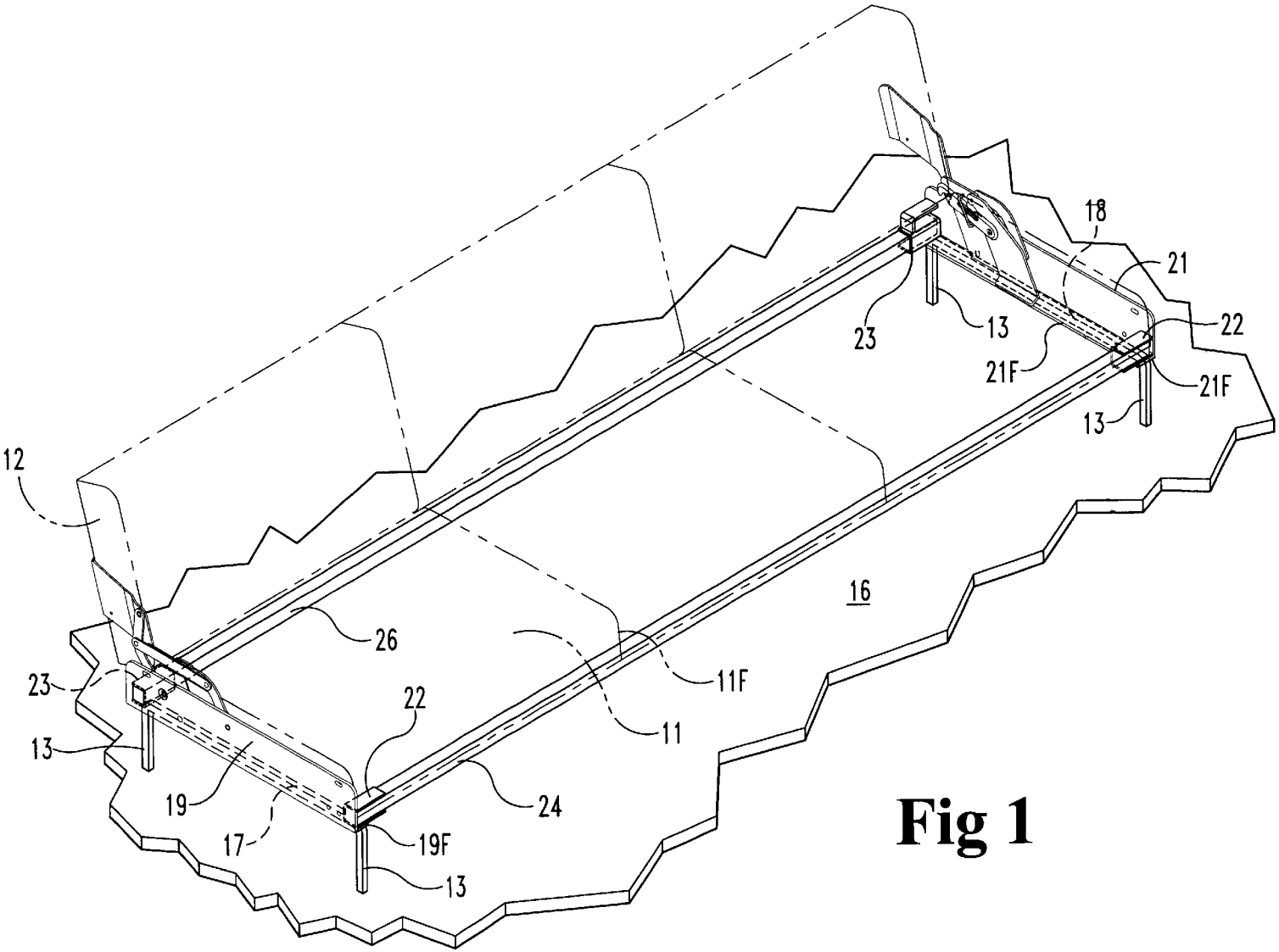
FIG. 1 is a front perspective view of a multi-purpose seat assembly according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the FIG. 1 perspective view of the sofa assembly shows a seat 11, backrest 12, and legs 13, four of which support the sofa above the floor 16. The legs support two end members, 17 at one end of the sofa and 18 at the other end. These end members support side rails 19 and 21 on flanges 19F and 21F at opposite ends of the sofa. Each of the side rails has front and rear channels 22 and 23, respectively, which receive front 24 and rear 26 sofa frame members. This configuration of the sofa assembly will be referred to hereinafter as the forward configuration, to distinguish it from an alternate configuration in which the backrest 12 is flat and the seat 11 is upright to serve as a backrest in a rear facing position.

Figure 10:
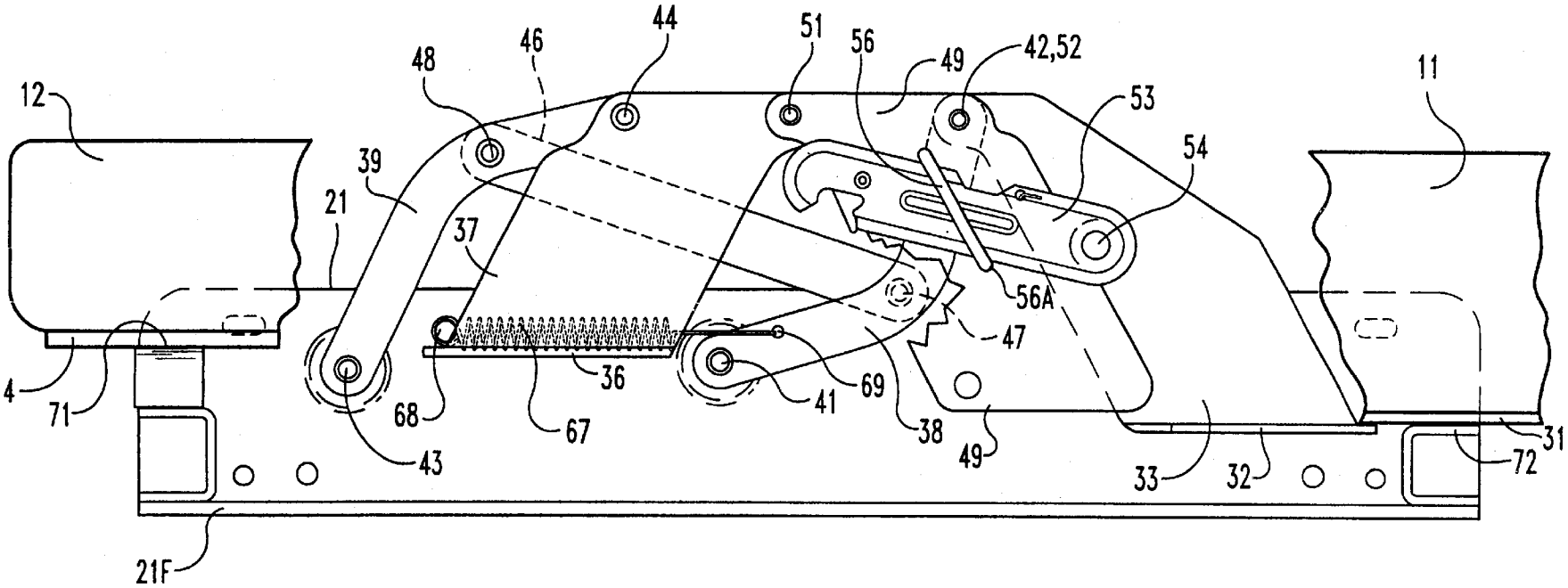
FIG. 10 shows is an elevational view of the hinge assembly showing the seat lowered all the way down onto the rest position supported by a front support on the side rail of the hinge assembly.

Many of the components of the hinge assembly according to the present invention, are most easily seen in the bed-forming configuration of FIG. 10. Each of the side rails serves as the base of a novel hinge assembly according to my present invention. This hinge assembly enables use of the sofa in the forward configuration, a bed configuration, or a rearward (backward) configuration. It also enables access to space below the seat by simply raising the seat to a storage access position, which is particularly advantageous if the sofa is provided with an enclosure around the storage space as in my U.S. Pat. No. 5,787,522 and suggested in U.S. Pat. No. 6,082,805 issued Jul. 4, 2000 to Larry E. Gray and me. The disclosures of those patents are incorporated herein to any extent which may be helpful.

To facilitate understanding of the invention, the following description will focus on the hinge assembly at the far end of the sofa and will maintain the orientation of the side rail itself consistent in all views of the drawings. The hinge assembly at the near end of the sofa is a mirror image of that at the far end, so a separate description of it will not be needed.

Figure 2B:
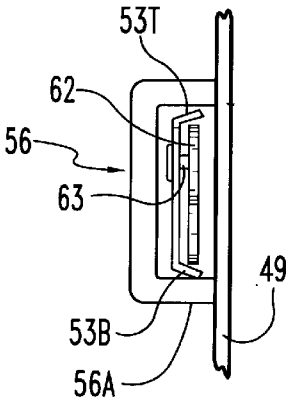
FIG. 2B is a section through the latch arm and stop taken at line 2B—2B in FIG. 2A and viewed in the direction of the arrows.
Figure 2A:
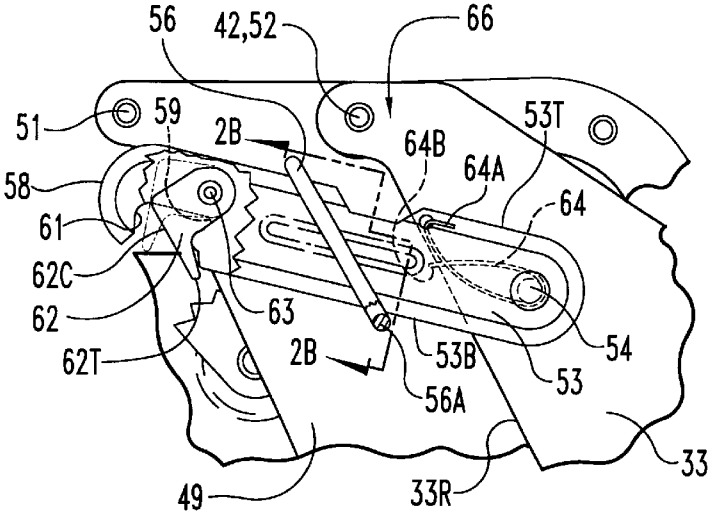
FIG. 2A is an enlarged fragmentary elevational view of a portion of FIG. 2 and showing the latch arm and guide/stop.
Figure 2:
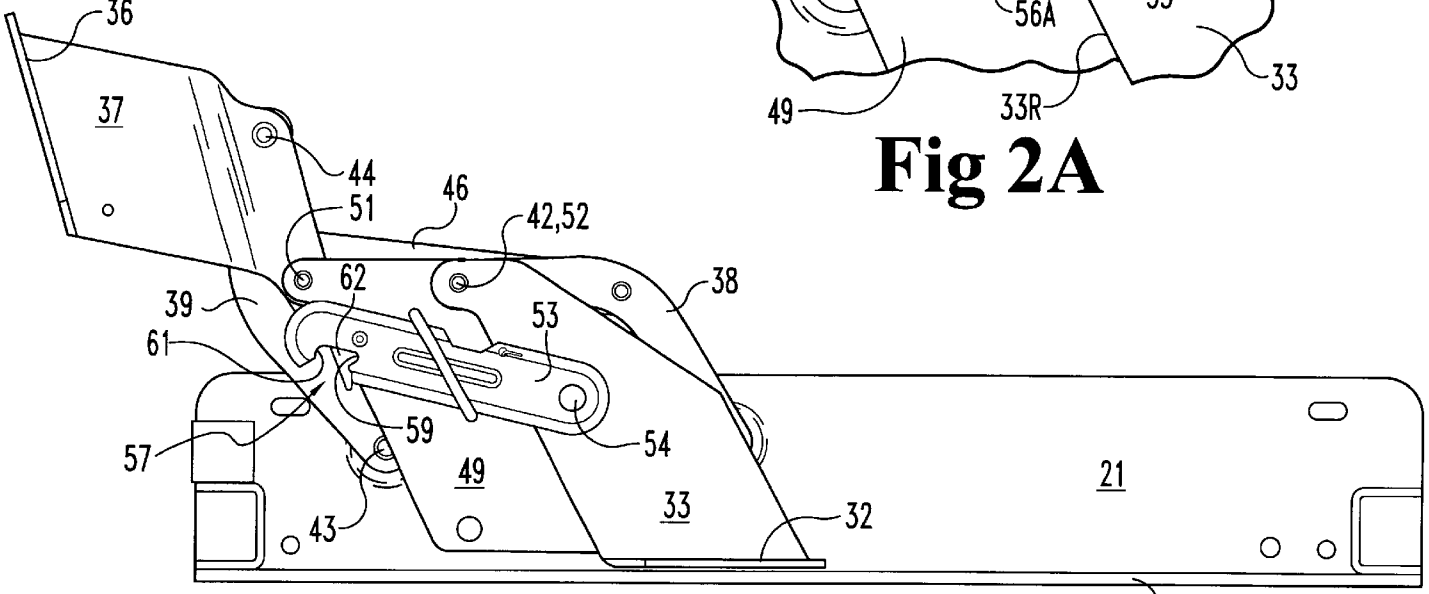
FIG. 2 is an elevational view of the hinge assembly according to a typical embodiment of the present invention and in its configuration when the seat assembly is in the forward-facing sofa configuration shown in FIG. 1.

Referring to FIGS. 1, 2 and 10, the seat 11 and backrest 12 can be of any of a variety of types of construction which are well known and widely used. Typically, they will include a generally rectangular tubular frame such as 31 with springing (not shown), which may be of a serpentine nature or some other well known type and covered with suitable padding and upholstery. In the case of the seat, the seat frame 31 is supported at its ends on seat carriers of the hinge assemblies. In the illustrated example the seat frame is attached to an inwardly projecting horizontal flange 32 of seat bracket 33 of the hinge assembly of this invention. Screws or bolts (not shown) are typically provided for this purpose. In the case of the backrest, it is typically constructed in the same manner as the seat, although usually (but not necessarily) of smaller height, and has less padding, and the frame 34 thereof is supported on backrest carriers of the hinge assembly. For the illustrated example, the frame 34 of the backrest is secured to an inwardly projecting flange 36 of backrest bracket 37 of the hinge assembly. As in the case of the seat, the attachment may be by screws, bolts or other means.

The above-mentioned brackets are connected to the frame side rail 21 by a front pivot arm 38 and a rear pivot arm 39. The front pivot arm is pivotally pinned to the side rail at 41 and to the seat bracket 33 at 42. The rear pivot arm 39 is pivotally pinned to the side rail 21 at 43 and to the backrest bracket 37 at 44. The pivot arms are connected to each other by a cross link 46, which is pivotally pinned to the front pivot arm at 47 and to the rear pivot arm at 48. An intermediate hinge carrier shown in the form of hinge plate 49 is pivotally pinned to the backrest bracket at 51 and to the seat bracket and front pivot arm at 52. A latch arm 53 is pivotally pinned to the seat bracket at 54. It is received through a guide 56 which is affixed to the hinge plate 49 and, as best shown in FIGS. 2A and 2B, has somewhat the appearance of a staple although, of course, without any prongs. In addition to serving as part of the guide 56, the bottom portion 56A thereof also serves as a stop for a latch, as will be described here.

The latch arm is shown in the form of a generally channel-shaped stamping having a downwardly opening latch notch 57 near its rear or distal end 58. The notch has a front end 59 of semi-circular configuration and a rear end 61 of semi-circular configuration. The latch arm also has a latch dog 62 pivotally pinned to it at 63.

Referring to FIG. 2A, the arm 53 is spring loaded by a spring 64 wound around pin 54 and having one end 64A bearing down on the top of top flange 53T of the arm. The other end 64B of the spring bears on the rear edge 33R of the seat bracket 33. The spring 64 is stressed such that it is trying to open up, which results in the end 64A bearing down in the direction of arrow 66 (FIG. 2A). The counterclockwise movement of the latch arm about the pivot pin 54 which would otherwise be imparted by the unwinding of spring 64, is stopped by the bottom flange 53B of the arm bearing on the top of the stop portion 56A of the guide 56. The spring biases the arm in the counterclockwise direction at all times, so that whenever the position of the arm on the stop has moved to a position of registry of the notch 57 with the stop 56A, the arm will tend to pivot counter clockwise and receive the stop 56A somewhere in the notch 57.

As mentioned above, the latch dog 62 is pinned at 63 in the arm 53. The latch dog is free to move about the pivot pin 63 with its clockwise limit relative to the arm shown in the dashed line in FIG. 2A and its counterclockwise limit shown by the solid line in FIGS. 2, 2A, 9, 9A and 10.

A backrest return spring 67, with a rear end connected to the side rail 21 at 68, and a front end connected to the front pivot arm 38 at 69, is always in tension, tending to hold the backrest in the forward facing position. The amount of tension depends on the relative positions of the hinge assembly components as they affect the position of the front pivot arm about pin 41.

Procedure

The hinge assembly at the far end of the sofa has been described, and with the understanding that the assembly at the near end of the sofa is a mirror image thereof and operates in the same way, the procedure for converting a forward facing sofa to a bed and to a sofa with a rearward facing backrest and back to original sofa condition, will be described now.

Sofa Condition—Forward Facing Backrest, Converting to Bed

Figures 3, 3A:
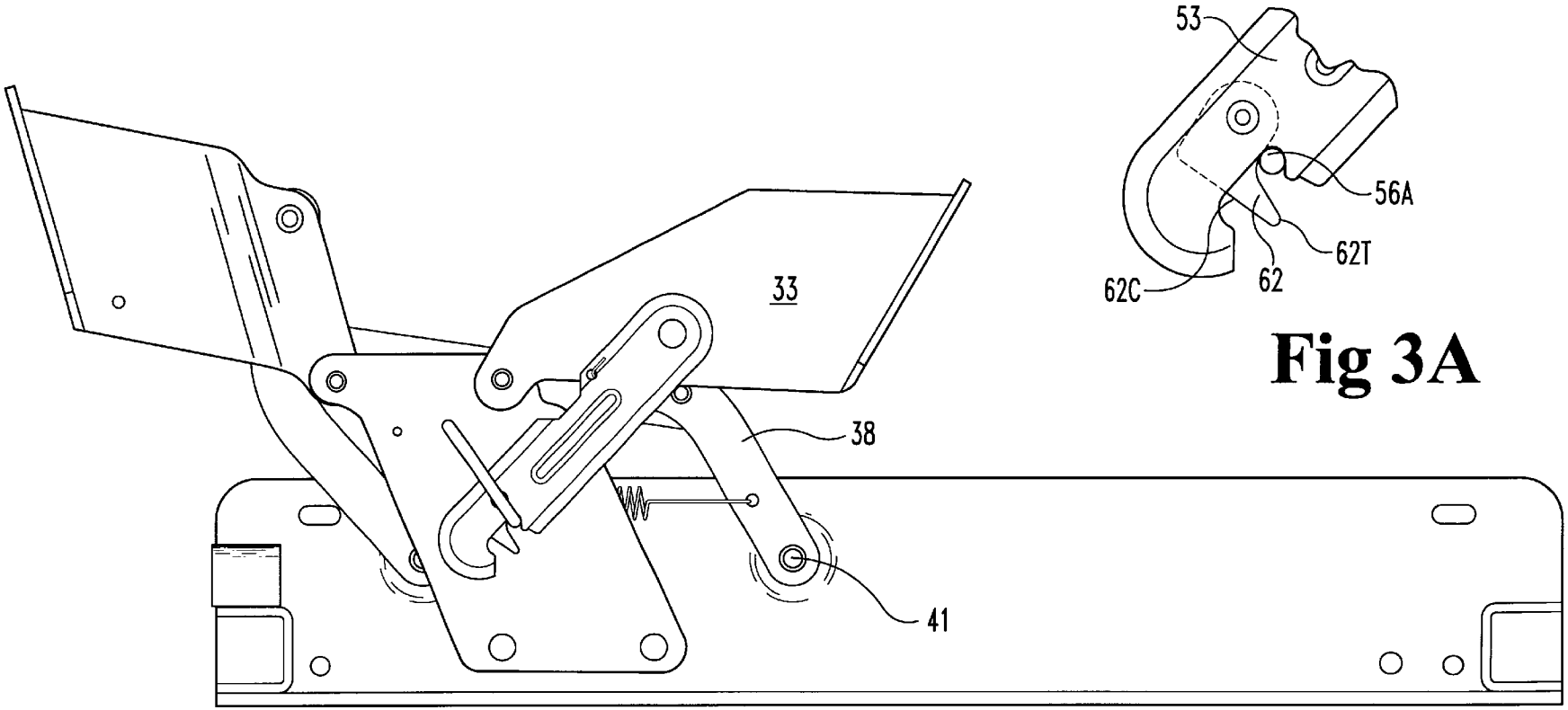
FIG. 3 is an elevational view of the hinge assembly when the front edge of the seat is raised for access to storage under the seat.
FIG. 3A is an enlarged fragmentary elevational view of a latch arm and stop with the latch arm in position with the front end of a latch notch engaged with the stop.
Figure 4:
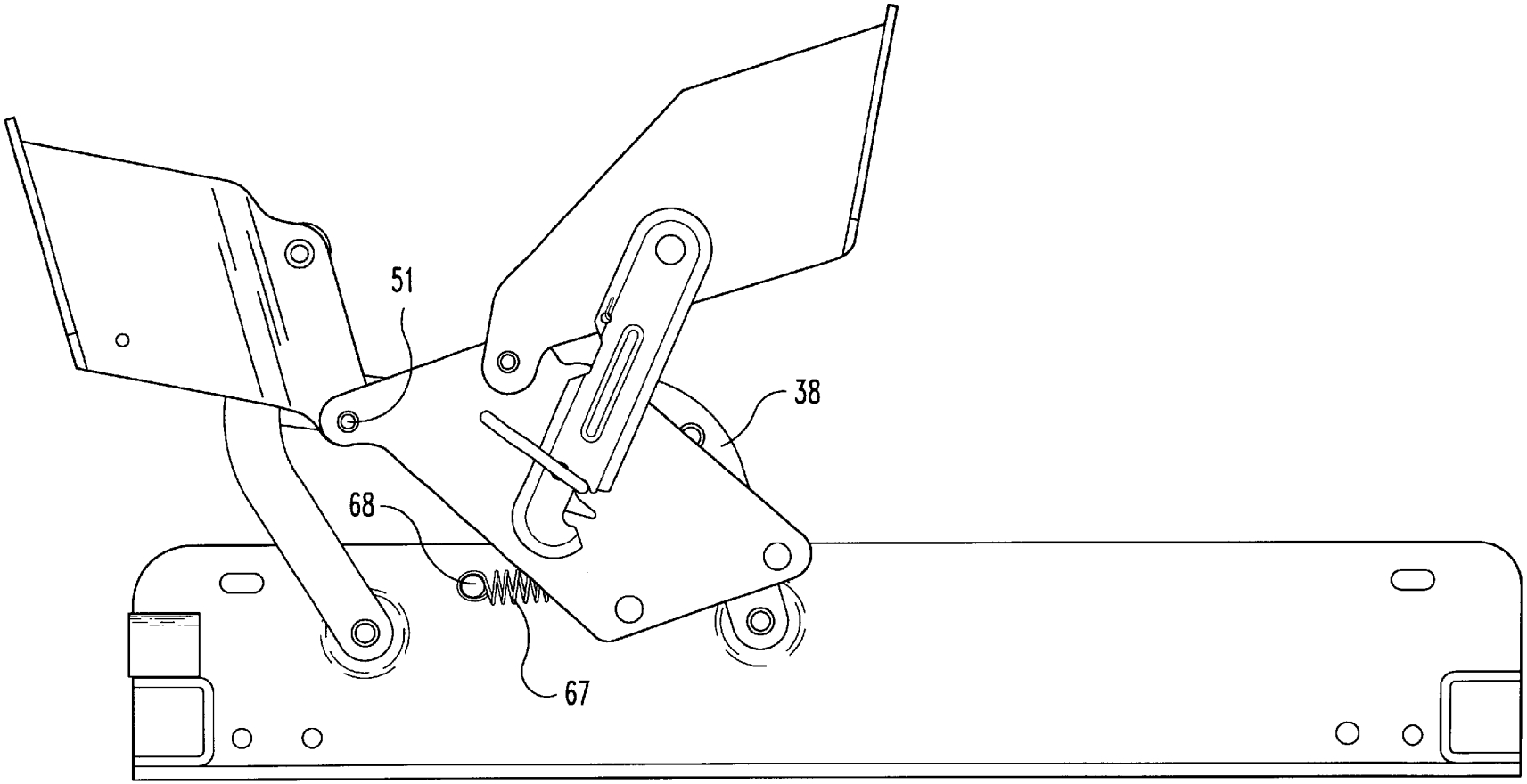
FIG. 4 is an elevational view of the hinge assembly as the front end of the seat is lifted and pulled forward to move the backrest forward toward a bed configuration.
Figure 5:
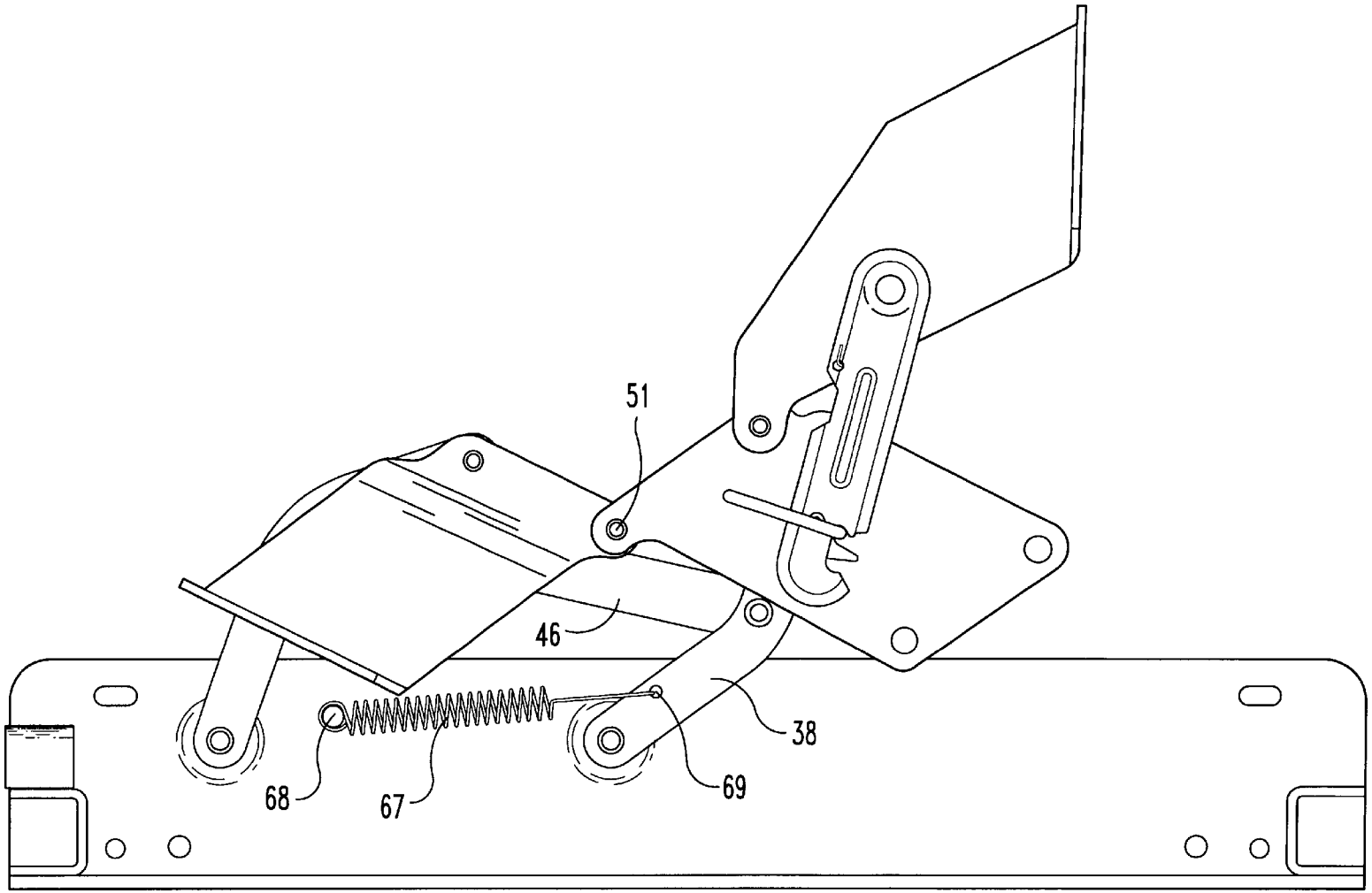
FIG. 5 is an elevational view of the hinge assembly as the backrest pivots down and the back return spring is nearing a low leverage, nearly neutral, position.
Figure 6:
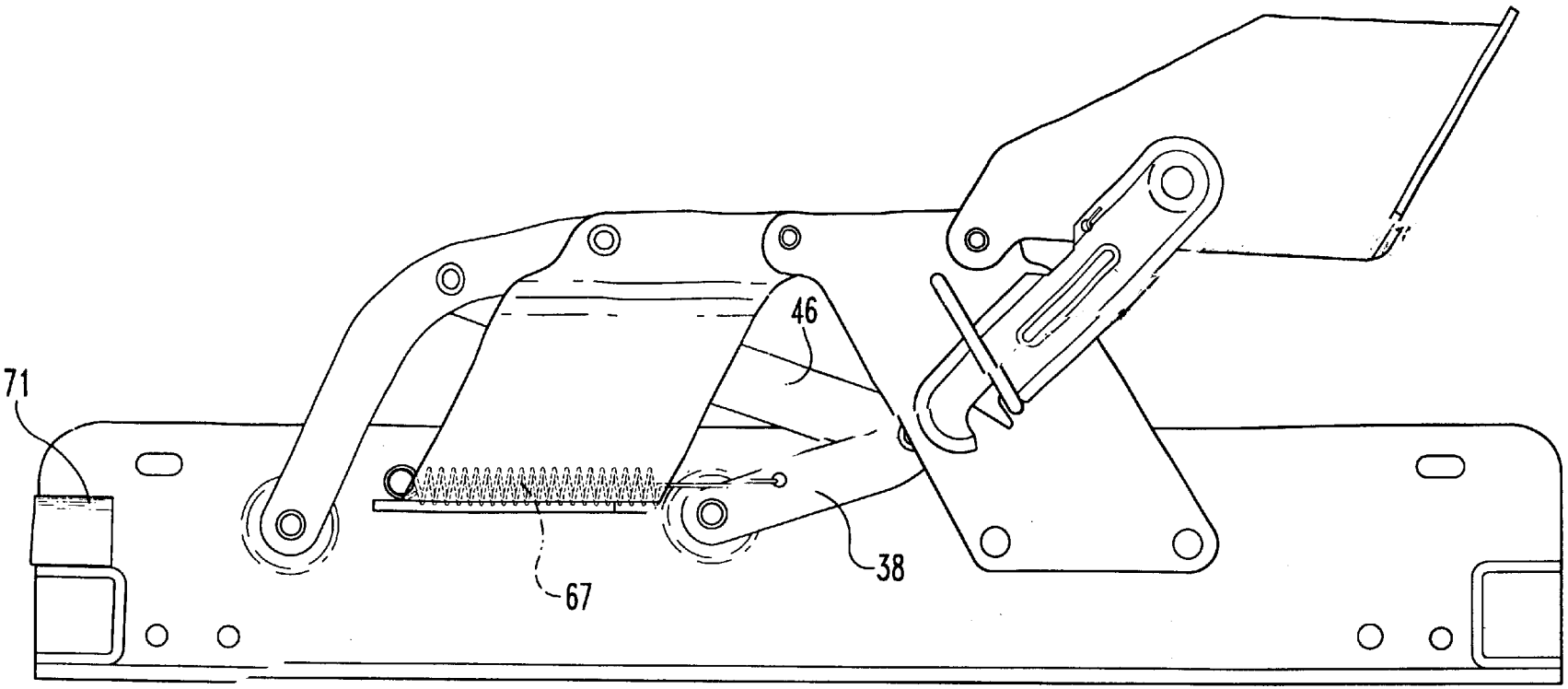
FIG. 6 is an elevational view of the spring assembly when the backrest is down on a rear support on the side rail of the hinge assembly, and the return spring is in a low leverage position.
Figures 7, 7A:
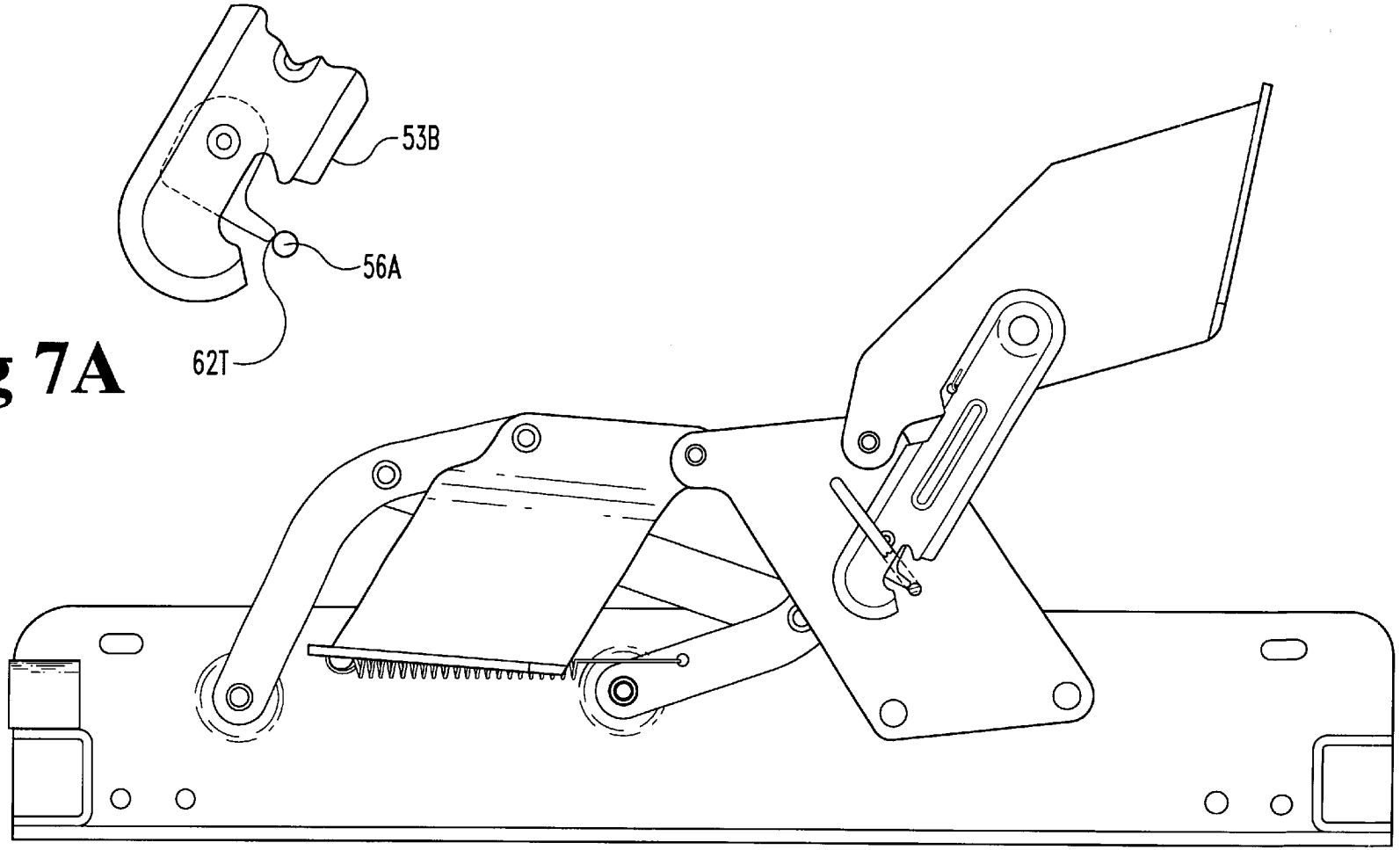
FIG. 7 is an elevational view of the hinge assembly in which the front edge of the seat is raised further to further pivot the latch arm and to force a latch dog in the latch arm to ride over the top of the stop and enable the arm to receive the stop into a rear end of the notch, enabling the seat to be pushed down to bed position.
FIG. 7A is an enlarged fragmentary elevational view of the condition of FIG. 7 with the latch dog riding over the stop as the latch arm moves upward.
Figures 8, 8A:
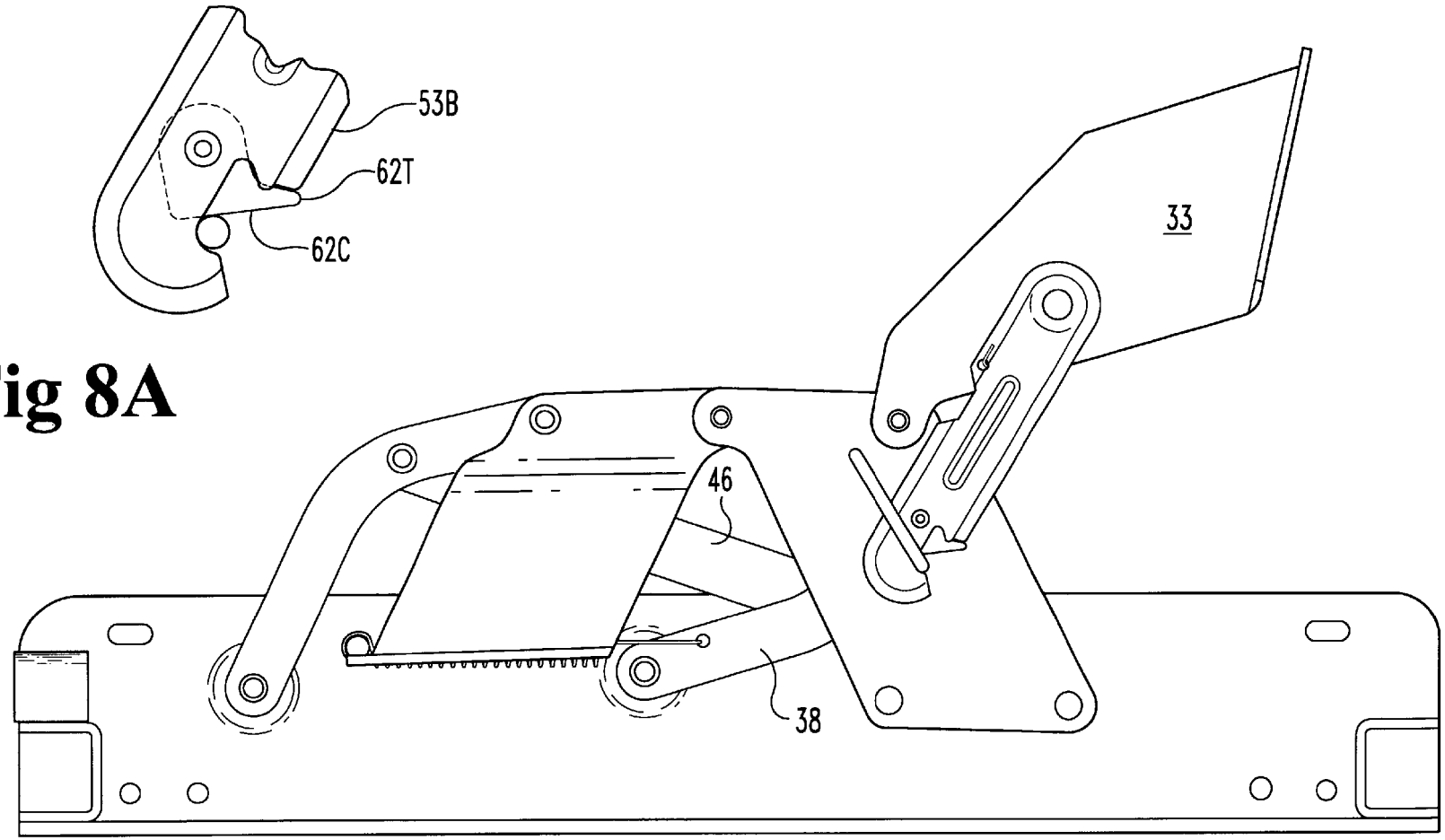
FIG. 8 is an elevational view showing the stop in the rear end of the notch.
FIG. 8A is an enlarged fragmentary elevational view showing the stop in the rear end of the notch.
Figures 9, 9A:
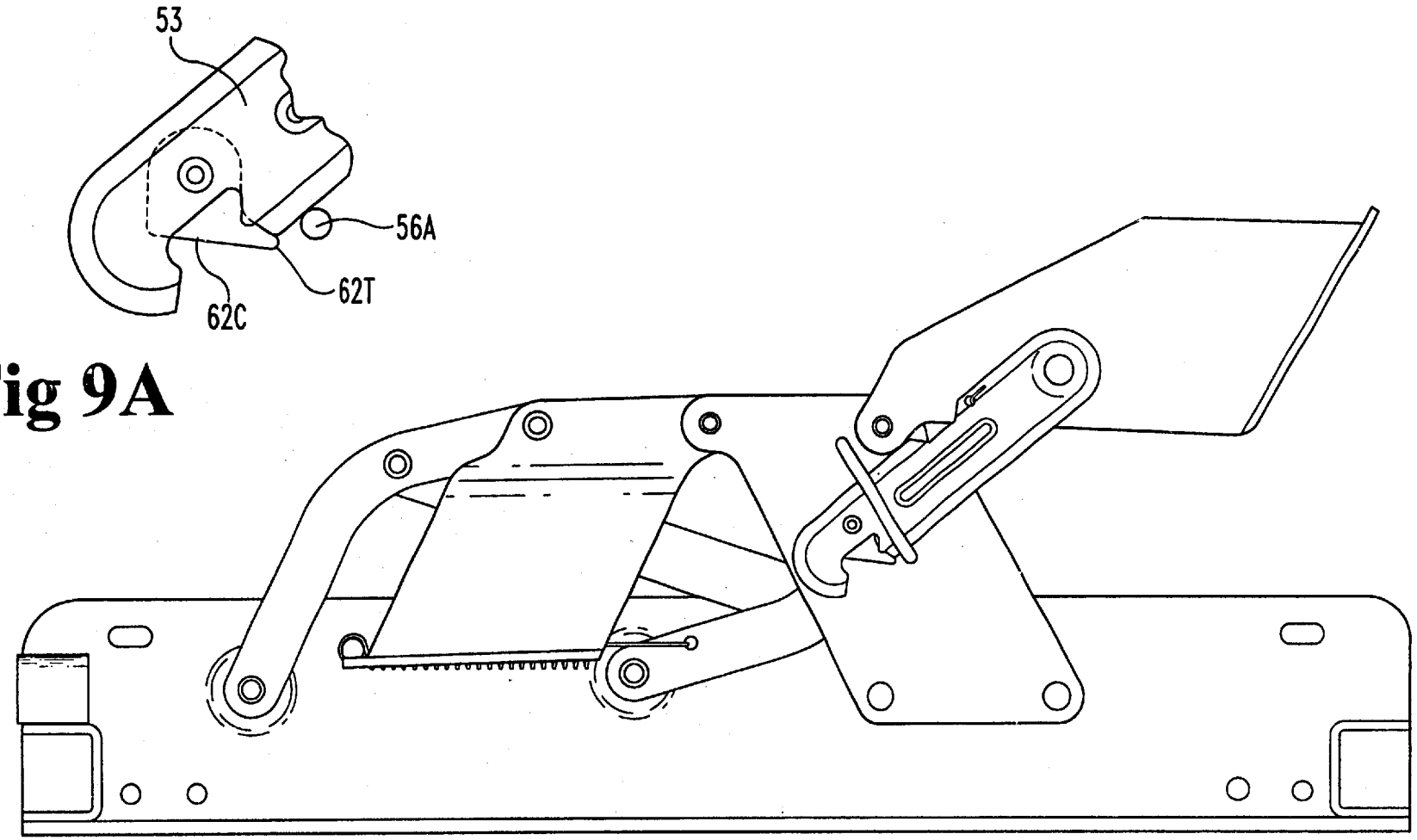
FIG. 9 shows the assembly with the seat being lowered, reversing the latch dog to enable the latch arm to ride over the stop and avoid latching.
FIG. 9A is an enlarged fragmentary elevational view of the latch arm as it has moved rearward and toggled the latch dog in a forward, notch-closing direction as the arm moved rearward over the stop in response to the seat being lowered.

To make the sofa into a bed, lift the front edge 1F of the seat up. The latch arm 53 is pulled forward and upward and, being spring-loaded counterclockwise, the latch arm slides along the stop 56A until the front end 59 of the latch notch 57 gets to the stop 56A. Meanwhile, latch dog 62, being pinned at a location remote from the tip 62T, and hanging from it, may turn clockwise relative to the arm, due to the weight of the latch dog itself, virtually all of which is below the pivot pin 63. In any event, when the projecting tip 62T of the latch dog reaches the stop 56A, the stop will push the latch dog clockwise, while the counterclockwise spring bias on the arm will force it downward and, with the latch dog tip 62T pointed down, the front end of latch notch drops onto stop 56A and arm 53 is thereby latched in its first position relative to the latch plate (FIG. 3). As the seat continues to be pulled upward and forward, the combination of the hinged connection of the seat bracket to the hinge plate at 42, and the latch arm latched to the stop 56A, causes the front pivot arm 38 to be pulled forward (FIG. 4). This action, through the connection of the hinge plate to the backrest bracket at 51, causes the backrest bracket to be pulled forward (FIG. 4) against the resistance of the return spring 67, which is being stretched during this operation. Further forward pulling of the front edge of the seat, and the relationship of the pivot arms and pivot pins 42 and 44 thereof to the seat bracket 33 and backrest bracket 37, respectively, and the cross link 46 to the two pivot arms, has initially depressed the backrest pivot point 51 but is now causing it to rise as in FIG. 5, which has begun to move the backrest toward a horizontal position. Further forward pulling of the front edge of the seat pulls the backrest further forward and down to a horizontal position shown in FIG. 6, whereupon the frame 34 of the backrest comes to rest on top of a support shelf 71 on the frame side rail 21. At this point and, as shown in FIG. 6, the return spring 67 is virtually horizontal and at an extremely low leverage position on the front pivot arm 38. The weight of the backrest will thus keep the assembly in this configuration. Then, to move the seat portion downward to finish the bed, the front edge of the seat is lifted to move it upward slightly. The latch dog 62 cannot turn farther clockwise relative to the latch arm 53 because it is abutting the undersurface of the top flange of the latch arm. Therefore, the latch dog 62, being forced upward against the spring loading of the arm as it passes stop 56A (FIGS. 7, 7A), pushes the arm clockwise slightly against the loading of spring 64 until the latch dog tip 62T rides over (FIGS. 7, 7A) stop 56A and exposes the rear end 61 of the latch notch to the stop 56A, whereupon the arm snaps down to receive the stop 56A in the rear end of the notch (FIGS. 8, 8A). As this occurs, the cam surface 62C of latch dog 62 bearing on the stop 56A, is turned counterclockwise relative to the arm 53, whereby it closes the front end of the notch as it did initially in FIG. 2, and tip 62T projects slightly below the bottom surface 53B of latch arm 53. Then, upon pushing the front edge of the seat down, cam surface 62C of the latch dog engaging stop 56A cams the arm against loading of spring 64 in clockwise direction relative to pivot 54 and seat bracket 33. Thereby the cam surface cams the arm outward from the stop 56A and enables the latch arm (FIG. 9) to slide over the latch dog tip 62T and rearwardly through the guide as the front edge of the seat is lowered to place the seat frame on top of the support shelf 72 to support the seat. Now the assembly is in the bed configuration.

Bed Configuration to Rearward Facing Sofa Configuration

For this procedure, it is only necessary to start with a sofa configuration and pull up the front edge of the seat portion until the latch arm sliding along the stop 56A gets the front end of the notch 57 to the stop 56A, whereupon the arm will drop and latch the seat, now in the generally upright position to serve as a backrest. Note that this position happens to be the same as the seat position before the last step converting to the bed configuration.

Backward Sofa Configuration to Forward Sofa Configuration

To return from the backward facing sofa configuration, it is only necessary to return first to the sofa configuration by simply pushing or pulling up on the front edge of the seat to allow the latch arm to receive the stop in the rear end of the notch and continue to raise and move backward on the front edge of the seat and allow it to return under the urging of the return spring so the backrest is automatically moved up to the forward facing position aided by the return spring 67. Then the front edge of the seat is moved downward, the downward force pivoting the latch counterclockwise, as discussed above, enabling the arm 53 to move rearward through the guide, whereby the seat can be lowered to its original sofa position (FIGS. 1 and 2).

Sofa Condition—Forward Facing Backrest—Access to Storage

For access to storage under the sofa seat 11, the same procedure is followed as the first step to convert to a bed. However, the seat is raised no further than necessary to have the latch arm latch in the forward end of the notch. To close, the front edge of the seat is lifted slightly upward and rearward, enough to cause the latch dog tip 62T to ride over the stop 56A which turns the latch dog counterclockwise, and enables the rear end 61 of the latch notch to engage the stop. Then the seat can be pushed down, whereupon the arm is cammed outward and rides over the stop 56A and slides rearward through the guide, thereby enabling the seat to be lowered to the sofa position.

It may be seen from the foregoing description that the present invention enables construction of a seating assembly having great versatility but requiring no pull handles, knobs, cables, cords, or rods. It is not necessarily limited to a use in various types of land, water or airborne vehicles, as it may find use in space craft or in stationary settings. Also, it is not limited to a sofa size, as it could be used for a seat or bed for one person.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A multi-purpose seat assembly for a space having a floor, the assembly having a seat and a backrest and comprising:

a pair of hinge assemblies adapted to being mounted above the floor;

said seat and said backrest being attached to said hinge assemblies and thereby adapted to assume a bed configuration, a forward sofa configuration, a backward sofa configuration, and an under-seat storage access configuration;

at least one of said hinge assemblies having a side rail and a first pivot arm and a second pivot arm, said arms being pivotally attached to the side rail at spaced locations, and a seat bracket attached to the seat and pivotally attached to the first pivot arm, and a backrest bracket attached to the backrest and pivotally attached to the second pivot arm;

a cross link pivotally attached to the first and second pivot arms;

a hinge plate pivotally attached to the seat bracket and to the first pivot arm at a first pivot location, and the hinge plate being pivotally attached to the backrest bracket at a second pivot location spaced from the first location, and the hinge plate having a stop thereon; and a latch arm pivotally attached to said seat bracket and having a notch at a location remote from the pivotal connection and oriented for automatic engagement of the notch with the stop to lock the assembly in certain ones of said configurations.

2. The assembly of claim 1, and further comprising:

means engaging said latch arm and biasing said latch arm toward constant engagement with said stop.

3. The assembly of claim 2 and wherein:

said means engaging said latch arm is a spring engaging said latch arm and said seat bracket.

4. The assembly of claim 2 and wherein:

the location of pivotal attachment of said latch arm to said seat bracket is spaced from said first pivot location whereby said seat bracket is movable relative to said hinge plate about the first pivot location to simultaneously move said latch arm along said stop to a position of registry of said notch with said stop to latch the arm to the stop.

5. The assembly of claim 4 and further comprising:

means on said latch arm and at said notch and operable between positions controlling access of said stop to said notch.

6. A multi-purpose seat assembly for a space having a floor, the assembly having a seat and a backrest and comprising:

a pair of hinge assemblies adapted to being mounted above the floor;

said seat and said backrest being attached to said hinge assemblies and thereby adapted to assume a bed configuration, a forward sofa configuration, a backward sofa configuration, and an under-seat storage access configuration;

at least one of said hinge assemblies having a side rail and a first pivot arm and a second pivot arm, said arms being pivotally attached to the side rail at spaced locations, and a seat bracket attached to the seat and pivotally attached to the first pivot arm, and a backrest bracket attached to the backrest and pivotally attached to the second pivot arm;

a cross link pivotally attached to the first and second pivot arms;

a hinge plate pivotally attached to the seat bracket and to the first pivot arm, and the hinge plate being pivotally attached to the backrest bracket at a second pivot location spaced from the first location, and the hinge plate having a stop thereon;

a latch arm pivotally attached to said seat bracket and having a notch at a location remote from the pivotal connection and oriented for automatic engagement of the notch with the stop to lock the assembly in certain ones of said configurations;

means engaging said latch arm and biasing said latch arm toward constant engagement with said stop;

the location of pivotal attachment of said latch arm to said seat bracket is spaced from said first pivot location whereby said seat bracket is movable relative to said hinge plate about the first pivot location to simultaneously move said latch arm along said stop to a position of registry of said notch with said stop to latch the arm to the stop;

means on said latch arm and at said notch and operable between positions controlling access of said stop to said notch; and wherein said means on said latch arm is a latch dog.

7. The assembly of claim 6 and wherein:

said latch dog is pivotally mounted on said latch arm, the pivot location on said latch dog and relative to said notch being such that a surface of said latch dog provides a ramp from a portion of said notch to facilitate escape of said arm from said stop in one direction of movement of said arm relative to said stop.

8. A method of converting a sofa bed from a forward facing sofa configuration to a bed configuration, the sofa bed having a seat, a backrest and at least one hinge assembly having a stop, and a latch arm with a notch engageable with the stop, the method comprising:

raising a front edge of the seat from a seating first position to a second position and thereby enabling the notch to automatically engage the stop;

with the notch engaged with the stop, further moving the front edge of the seat from the second position upward and forward and thereby simultaneously moving said backrest forward from a backrest first position to a bed forming position;

while maintaining the backrest in bed forming position, raising the front edge of the seat to a third position disengaging the notch from the stop; and lowering the front edge of the seat and thereby releasing the notch from the stop, and continuing to lower the front edge to place the seat in a bed-forming position.

9. The method of claim 8 and further comprising, to convert the sofa bed from bed-forming configuration to a rearward facing sofa configuration, the method comprising:

raising the front edge of the seat from its bed forming position to automatically latch said notch on said stop whereby said seat is supported in an inclined, rearward-facing back-resting position.

10. The method of claim 9 and further comprising, to return from said rearward facing sofa configuration to forward facing sofa configuration:

raising the front edge of the seat further and rearward until the backrest has returned to a forward-facing, inclined back-resting position; and further raising the front edge of the seat and thereby disengaging said notch from said stop; and lowering the front edge of the seat and releasing the notch from the stop and continuing to lower the front edge to the seating position.

* * * * *